US006145996A

United States Patent [19]

Shimada

[11] Patent Number: 6,145,996

[45] Date of Patent: Nov. 14, 2000

[54] THEATER LIGHTING SYSTEM

[75] Inventor: Takehiko Shimada, Rolling Hills Estates, Calif.

[73] Assignee: Shimada Enterprises, Inc., Santa Fe Springs, Calif.

[21] Appl. No.: 09/036,286

[22] Filed: Mar. 6, 1998

[51] Int. Cl.[7] ..... F21S 8/00

[52] U.S. Cl. ..... 362/146; 362/240

[58] Field of Search ..... 362/146, 153, 362/240, 800

[56] References Cited

U.S. PATENT DOCUMENTS

| | | | |
|---|---|---|---|
| 1,420,059 | 6/1922 | Roth . | |
| 1,488,888 | 4/1924 | Lewensohn . | |
| 1,575,690 | 3/1926 | Kausal . | |
| 1,879,273 | 9/1932 | Irminger . | |
| 2,310,593 | 2/1943 | Orlicki . | |
| 2,635,681 | 4/1953 | Hiltman et al. . | |
| 2,766,372 | 10/1956 | Albris . | |
| 2,865,438 | 12/1958 | Machielse et al. . | |
| 3,057,991 | 10/1962 | Grenadier . | |
| 3,131,871 | 5/1964 | Foulds . | |
| 3,740,541 | 6/1973 | Conradt . | |
| 3,745,327 | 7/1973 | Lowery et al. . | |
| 3,753,217 | 8/1973 | Willfurth . | |
| 3,885,144 | 5/1975 | Lewis et al. | 362/146 X |
| 4,161,769 | 7/1979 | Elliott | 362/146 |
| 5,222,799 | 6/1993 | Sears et al. | 362/146 |

*Primary Examiner*—Stephen Husar
*Attorney, Agent, or Firm*—Lyon & Lyon LLP

[57] ABSTRACT

There is disclosed herein several lighting system particularly for theater stairs, aisles, floors and the like which both provide suitable lighting for patrons walking along these areas but without generating light that may be obtrusive to those sitting in seats, viewing a motion picture, or the like. The provide relatively simple lighting systems as compared to the commonly stair edge or nose lighting. One embodiment comprises a strip lighting fixture having a series of lamps adjacent a reflector located underneath the arm rest of a theater chair to illuminate the adjacent steps or aisle. A second embodiment involves small vertical strip lights on each side of the riser of each step of a stair. A third embodiment involves a hand rail having a series of lamps disposed therein or thereon, typically along with a lower clear or translucent lens covering the lamps and associated reflector. A fourth embodiment comprises strip lighting for use along an aisle or the like and which is designed to minimize the seepage of spilled liquid into or onto the lamps and wiring, and with a cover which can be readily and easily removed for clean up of spilled liquid.

10 Claims, 8 Drawing Sheets

THEATER LIGHTING SYSTEM

The present invention relates to lighting systems, and more particularly to theater lighting systems for illuminating stairway steps and aisles in theaters and the like for providing suitable illumination without providing obtrusive lighting.

BACKGROUND OF THE INVENTION

Various forms of lighting systems have been devised for theaters for lighting aisles, stairs and the like. Typically, low voltage string lighting systems are used which incorporate an incandescent or LED lighting strip having a number of spaced light bulbs or light sources.

In the case of steps and stairs, typically one or more stair "nosing" strips are provided at the edge or "nose" of each stair. For a number of years these devices have been provided for illuminating either upwardly from the forward edge of the stair or downwardly onto the riser and/or the next lower step so that the edge of each stair is illuminated whether one is walking up or down the stairway. Lighting systems of this nature are particularly desirable and useful in environments where the lighting level is low, such as in motion picture theaters and the like. With the advent of "stadium" type seating in motion picture theaters, stairs are more common in these theaters today, thereby creating a further need for suitable stair edge nose lighting.

Various forms of extrusions, either of metal such as aluminum, vinyl or plastic have been devised for holding a string of spaced light sources on a stair nose for either illumination upwardly or downwardly, or both. Typical lighting systems of this nature for illuminating both upwardly and downwardly involve either an extrusion for containing two sets of lights, or plural extrusions which are joined together with each holding a set of lights, for providing the upward and downward lighting. Generally, these lighting systems are relatively complicated because of the dual lighting systems involved.

In Applicant's co-pending application, Ser. No. 08/867,100 filed Jun. 2, 1997, the disclosure of which is incorporated herein by reference, an improved step lighting system for the stair edge or nose is provided, and wherein a single lighting string provides both the upward and downward illumination. In one embodiment, a combined lens and reflector is provided to allow light from a string of lights to be reflected upwardly and light from that string to impinge through the lens downwardly toward the riser and/or step below. In another embodiment, the extrusion houses a prism-type lens assembly for directing light both upwardly and downwardly. In another embodiment, the extrusion houses a dual reflector system for reflecting light from a light string both upwardly and downwardly. In a still further and preferred embodiment, the extension houses a lens and prism-type lens assembly for directing light both upwardly and downwardly but with improved downward illumination. In each instance, the extrusion may include slots at either end thereof for receiving the ends of carpet, such as carpet on the step and carpet on the riser.

Although the foregoing step lighting systems provide suitable lighting, they involve providing an extrusion for each stair edge or nose, as well as extrusions for providing wire ways to the various strings of light.

SUMMARY OF THE INVENTION

Accordingly, the present invention provides several alternative and/or additional lighting systems for theater stairs, aisles, floors and the like, and which both provide suitable lighting for patrons walking along these areas and without generating light that may be obtrusive to those sitting in seats, viewing a motion picture, or the like, but further provide relatively simple lighting systems as compared to stair edge or nose installation.

A first embodiment comprises a strip lighting fixture having a series of lamps or LEDs adjacent a reflector located underneath the arm rest of a theater chair (or under an outer edge of the chair) to illuminate the adjacent steps or aisle. The lamps in each embodiment preferably are LEDs. A second embodiment involves small vertical strip lights on one or both sides of the riser of each step of a stair. A third embodiment involves a hand rail having a series of lamps disposed therein or thereon, typically along with a lower clear or translucent lens covering the lamps and associated reflector. A fourth embodiment comprises strip lighting for use along an aisle or the like and comprises a series of lamps but which is designed in such a manner that in the event liquids are spilled thereon, the transparent or translucent cover thereof can be easily removed by snapping the same from the fixture for cleaning or drying up the spill. In this embodiment, an extrusion is provided which also covers the edge of carpeting for a floor, step or wall, and both a carpet-to-floor extrusion and a carpet-to-wall extrusion are disclosed.

Various forms of lighting system have been provided in the past for use in theaters and other locations. Examples of patents which disclose lighting associated with theater chairs include Kasual U.S. Pat. No. 1,575,690, Hiltman U.S. Pat. No. 2,635,681, Lewensohn U.S. Pat. No. 1,488,888, Irminger U.S. Pat. No. 1,879,273, Roth U.S. Pat. No. 1,420,059 and Machielse U.S. Pat. No. 2,865,438. Examples of stair lighting systems other than commonly used stair nose lighting systems are Willfurth U.S. Pat. No. 3,753,217 and Lowery U.S. Pat. No. 3,745,327. Examples of lights within a hand rail are found in Grenadier No. U.S. Pat. No. 3,057,991, Foulds U.S. Pat. No. 3,131,871, Elliott U.S. Pat. No. 4,161,769, Albris U.S. Pat. No. 2,766,372, Orlicki U.S. Pat. No. 2,310,593, and Conratt U.S. Pat. No. 3,740,541. None of these provide the relatively simple stair and aisle light systems or lighted hand rail as disclosed herein.

Accordingly, it is an object of the present invention to provide an improved lighting system.

An additional object of the present invention is to provide an improved step and aisle lighting system.

A further object of the present invention is to provide a single extrusion for holding a light directing member for directing light from a single string of lights onto a stair, aisle, floor or the like.

Another object of the present invention is to provide a new under arm lighting system for use under the arm rest of a theater chair for illuminating the adjacent stairs, aisle or floor.

Another object of this invention is to provide a new form of lighting system for the risers of stairs.

A further object of this invention is to provide a riser lighting system comprising a small vertical strip light fixture on one or both sides of the riser of each step of a stair.

An additional object of the present invention is to provide a new form of hand rail lighting system.

A further object of the present invention is to provide an improved form of strip lighting extrusion system for facilitating clean-up of spilled liquids thereon.

BRIEF DESCRIPTION OF THE DRAWINGS

These and other objects and features of the present invention will become better understood through a consideration of the following description taken in conjunction with the drawings in which:

FIGS. 4*a*–4*c* diagrammatically illustrate a vertical strip lighting system for the riser of stairs and wherein FIG. 4*a* is a perspective view of a theater stairway illustrating the lighting fixture on the side of each riser, FIG. 4*b* is an enlarged view of one fixture on one riser, and FIG. 4*c* is a cross-sectional view looking down into one lighting fixtures and illustrates a strip of LEDs used therein;

FIGS. 5*a* through 5*c* are detailed diagrams of one vertical strip light fixture like that diagrammatically shown in FIG. 4 and wherein FIG. 5*a* is a front view thereof on a riser with an associated wire way, FIG. 5*b* is a top view thereof, and FIG. 5*c* is a side view and showing a cross-section of an upper stair tread section;

DETAILED DESCRIPTION

Figure 1A:
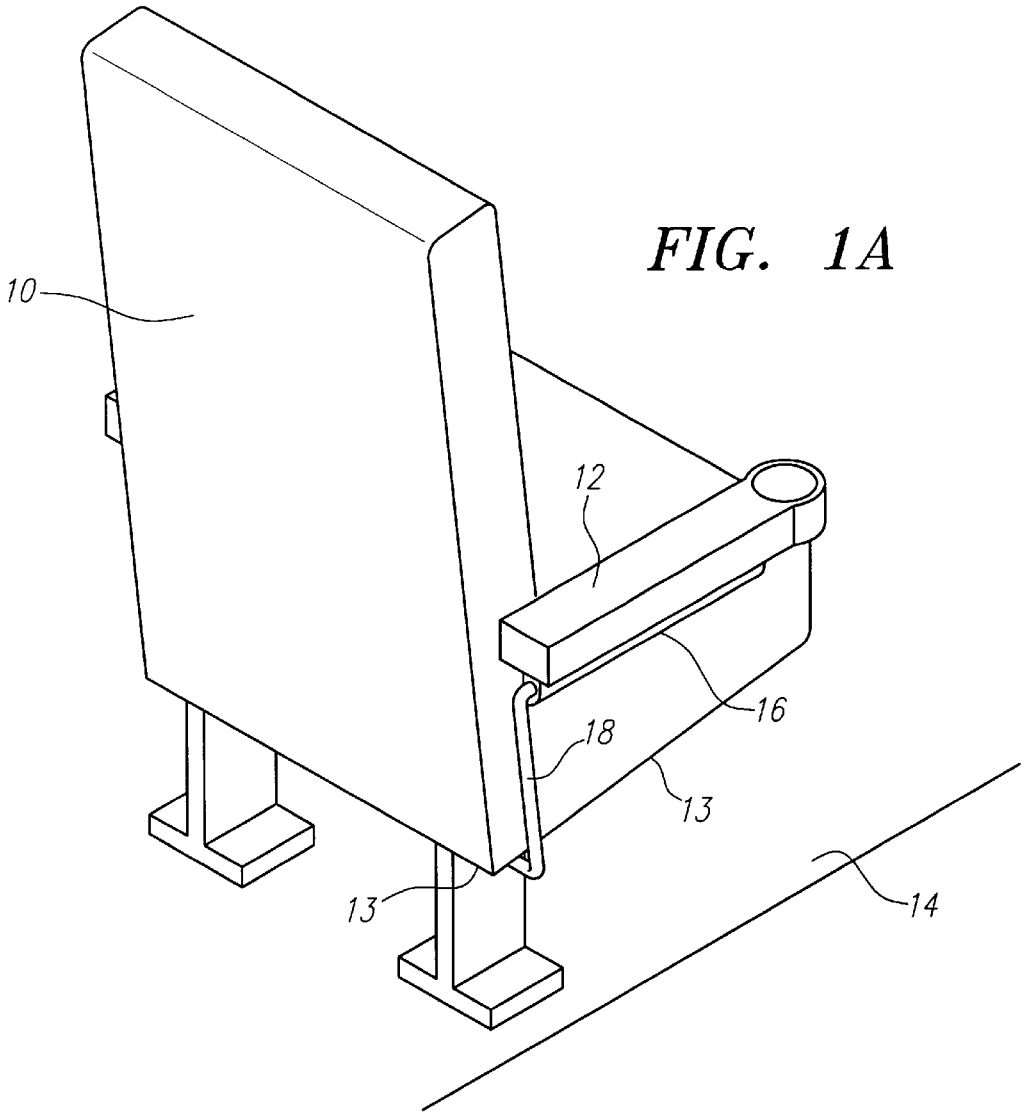
FIG. 1*a* is a perspective view of a theater chair illustrating a strip lighting fixture underneath the arm rest of the chair, and FIG. 1*b* diagrammatically illustrates a cross-sectional view of the lighting system.

Turning now to the drawings, and first to FIG. 1, there is shown a perspective view of a single typical theater seat 10 having an arm rest 12, and the seat 10 is adjacent an aisle 14. A strip lighting fixture 16 according to the present invention, is disposed and mounted beneath the arm rest 12 and has attached thereto a wire way 18 in the form of a tube or the like and which provides for connecting suitable electric power to the lights (not shown) within the fixture 16 and to a wire way installed on one or both sides of the carpeting. Alternatively, the fixture 16 can be mounted under the edge 13 of the chair 10.

Figure 1B:
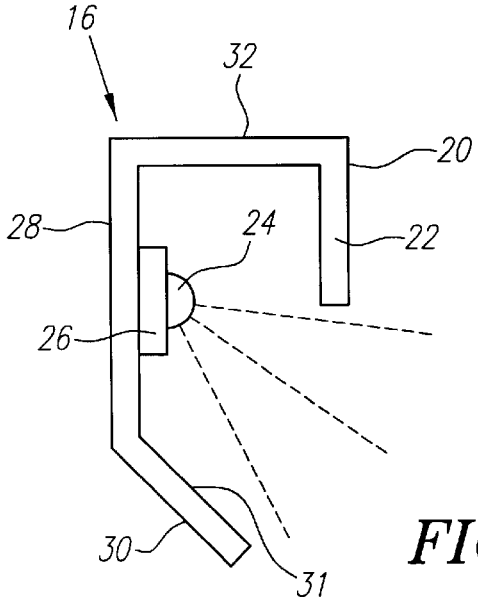

FIG. 1*b* is a diagrammatic view illustrating the basic concept of the under arm fixture 16. The same comprises an extrusion 20, typically formed of a suitable plastic material having a baffle section 22 on the floor or aisle side (e.g., 14) of the fixture 16. It includes a series of LEDs, typically 4–6, 24 electrically connected to an electrical power wire strip 26 mounted to a back 28 of the extrusion 16. An angled section 30 can be provided to form a reflector 31 for assisting in directing light from the LEDs 24 onto the associated carpet of the aisle 14 or stairs as the case may be. A top section 32 typically is mounted to the underside of the arm rest 12 of the chair 10. Suitable end caps (not seen in FIG. 1*b*) are provided to cover the ends of the fixture. The wire strip 26 is suitably connected to conductors within the wire way 18 and on to a suitable source of electrical power.

Figures 2A, 2B, 3:
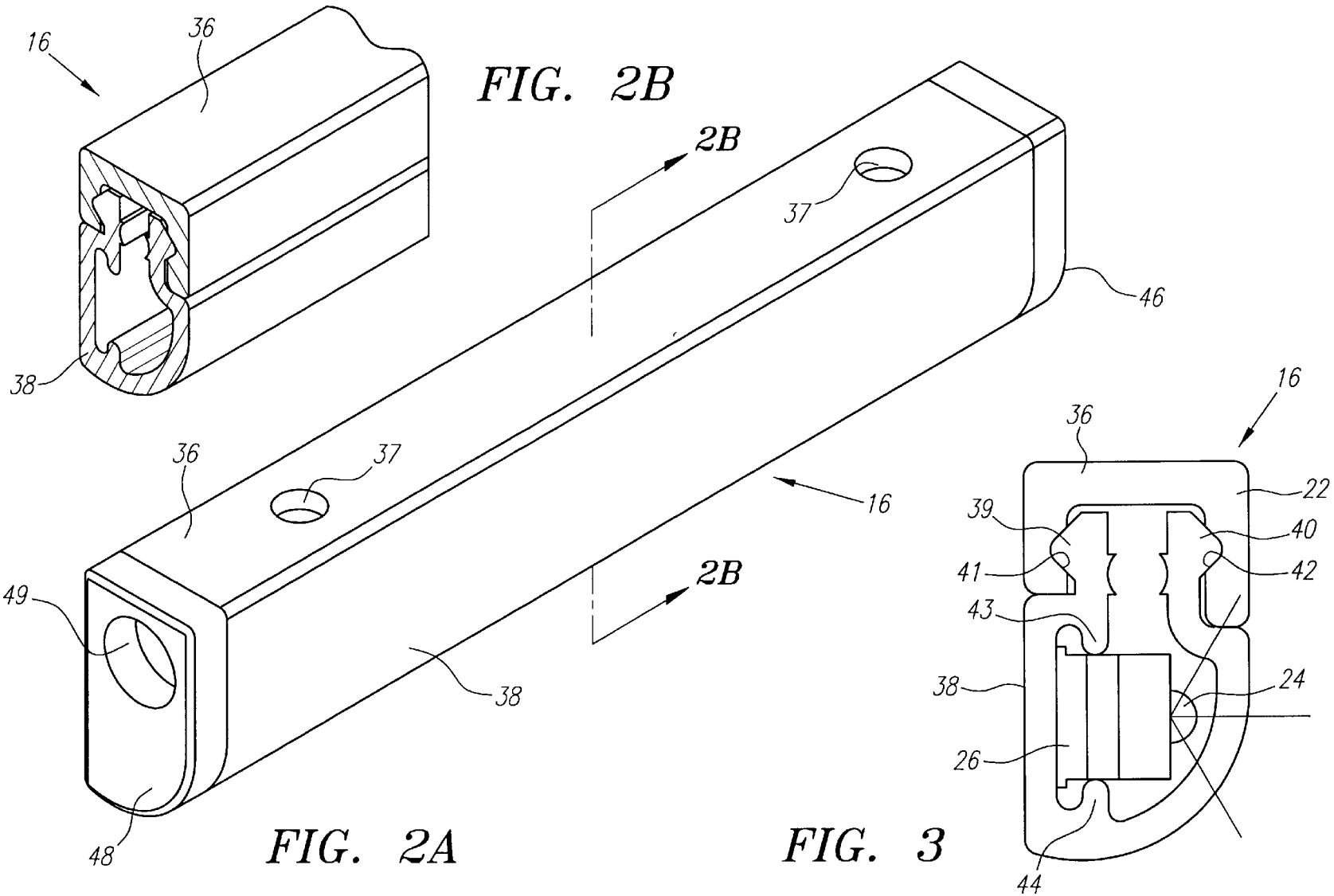
FIG. 2*a* is a perspective view of an under arm rest strip lighting fixture.
FIG. 2*b* is a cross-sectional view thereof, taken along a line 2*b*—2*b* of FIG. 2*a;*
FIG. 3 is an enlarged cross-sectional view thereof (the same as along a line 2*b*—2*b* of FIG. 2*a*) which shows in detail the interior light system.

Turning now to FIGS. 2 and 3, FIG. 2*a* is a perspective view of the under arm strip lighting fixture 16, and FIGS. 2*b* and 3 are cross-sectional views thereof. The fixture 16 comprises a first extrusion 36 forming a base, typically of a suitable plastic such as white PVC or other suitable plastic, or metal such as aluminum, and which includes holes 37 for allowing the same to be screwed or otherwise fixed to the under arm section of the chair arm 12 or under the edge of the chair. A second extrusion 38 which may be clear or translucent (or partially clear or translucent) and typically of polycarbonate or other suitable plastic is provided, and is configured as shown to have ears 39 and 40 which snap into respective similarly shaped slots 41 and 42 in the inside of the upper extrusion 36. A string of LEDs 24 such as 4–6 per arm, is provided, and these are suitably electrically connected to the power strip 26. A reflector (not shown) may be provided if desired. The strip or base 26 can be a snap fit into ears 43 and 44 of the second extrusion 38.

Suitable end-caps 46 and 48, typically of white PVC, are provided and preferably provide a tight seal to prevent tampering. The cap 48 has an opening 49 for connection to the wire way 18. The baffle section 22 is provided to minimize glare from the LEDs 24 and to assist in directing the light downwardly onto the associated aisle 14 or stair steps and at least half-way along the aisle or stair steps (assuming that there is a similar lighting fixture on the other side thereof or an alternative form of lighting fixture, such as a lighted hand rail to be discussed subsequently).

The typical stairs in a theater today have wire ways along the edges of the stairs and risers for providing electrical connections to the presently used stair nose lighting strips. These same types of wire ways can be used for powering the under arm fixtures 16 by running the wires through the wire way 18 (FIG. 1*a*).

Figure 4C:
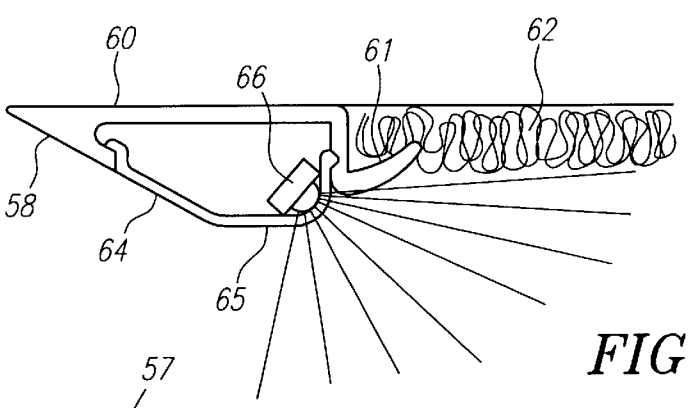
Figure 4B:
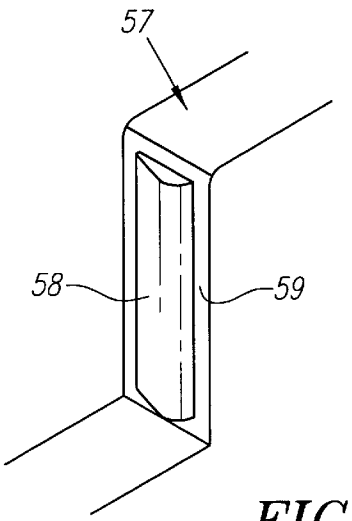
Figure 4A:
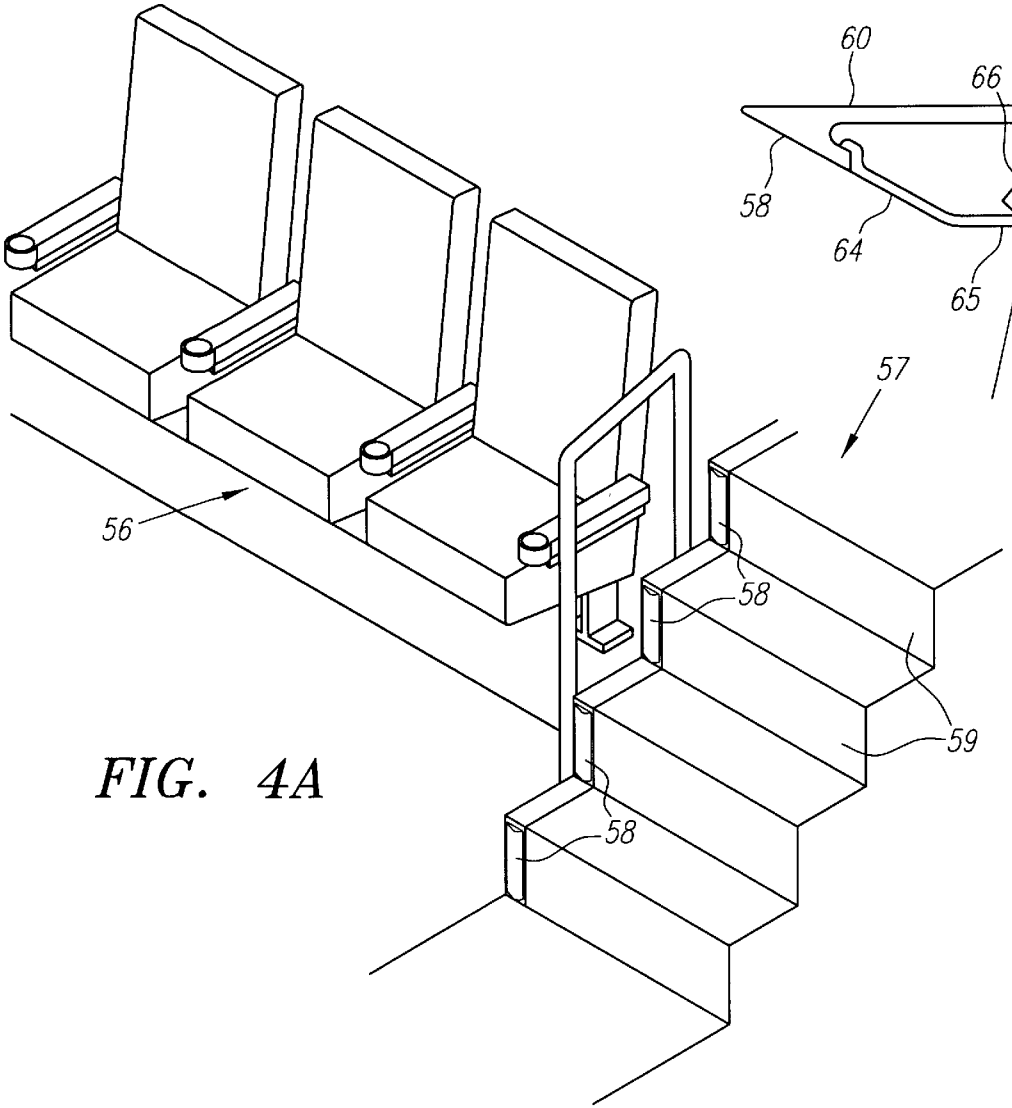

Turning now to FIG. 4, the same diagrammatically illustrates small vertical strip lights or strip light fixtures on one or both sides of the riser of each step of a stair way. FIG. 4*a* is a perspective view of theater chairs 56, a stair way 57, and strip light fixtures 58 disposed on the side of the riser 59 of each step. FIG. 4*b* is an enlarged view of a single view 59 and fixture 58. FIG. 4*c* is a diagrammatic top cross-sectional view of one fixture 58 illustrating a base extrusion 60 thereof which includes a lip 61 under which an edge of riser carpet 62 is disposed, and a second extrusion 64 which is at least clear or translucent in an area 65 for allowing light from an LED strip 66 to impinge on the adjacent riser and step. Typically, fixture 58 is provided on each side of the riser of each step of a stairway, with each fixture suitably illuminating approximately half of a riser.

Figure 5A:
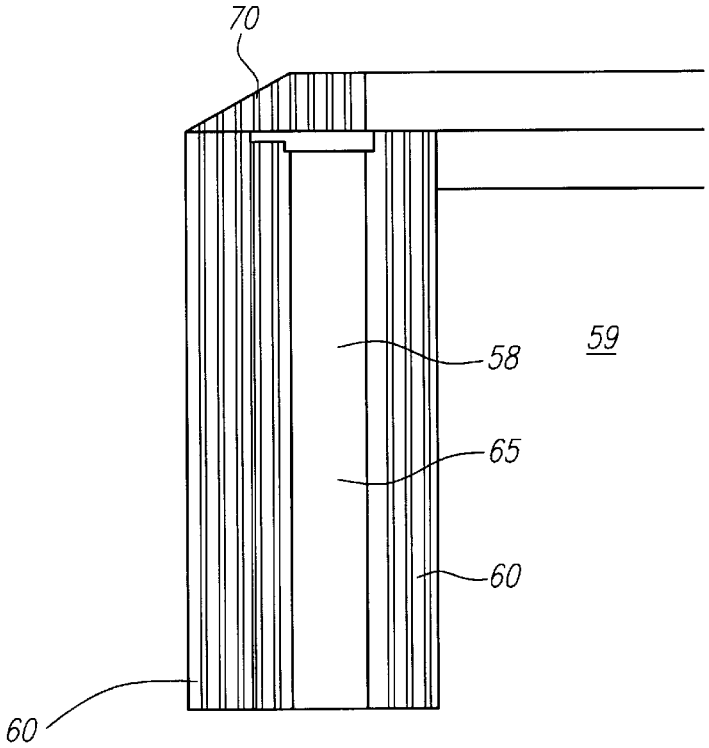
Figure 7:
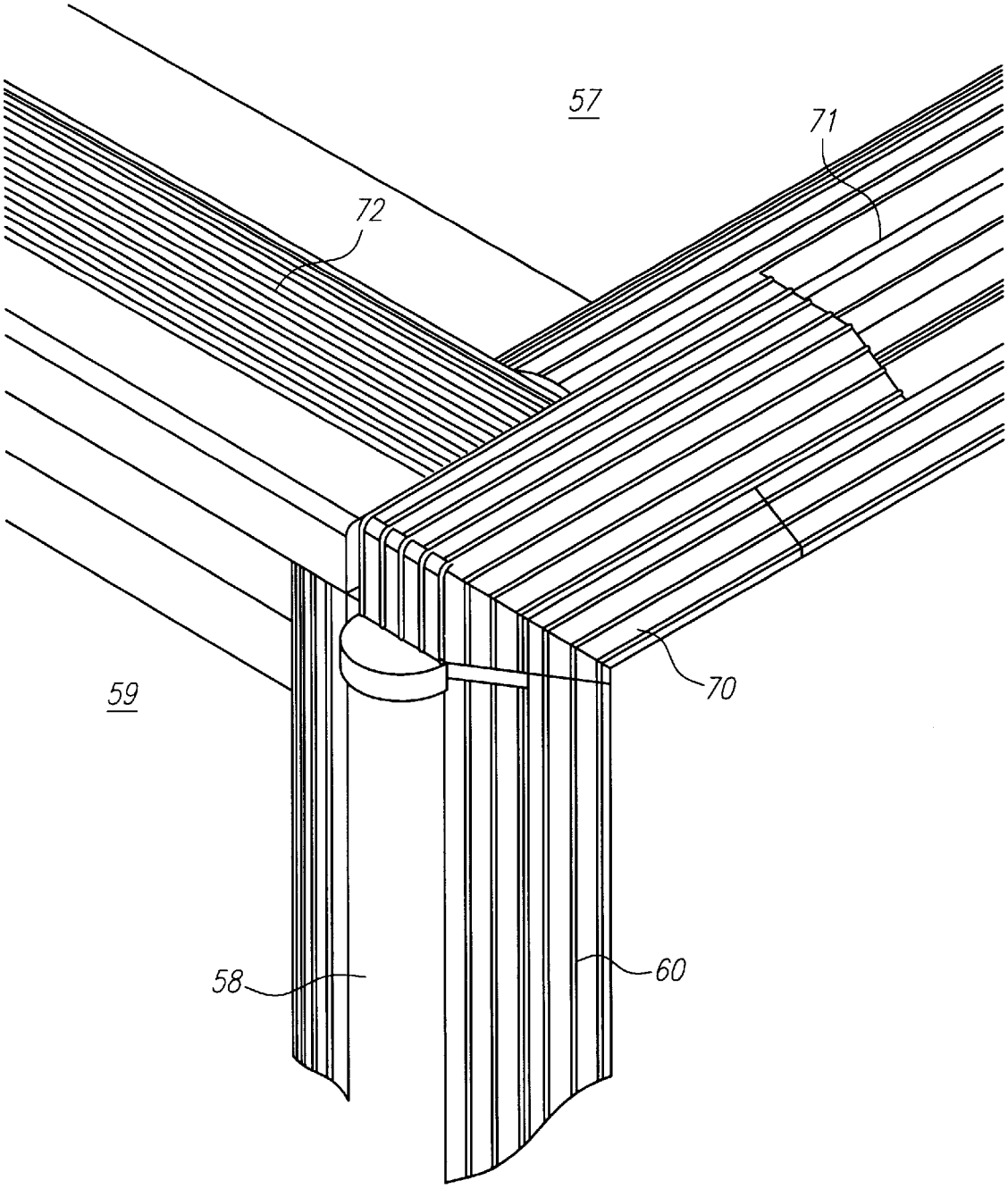
FIG. 7 is an enlarged perspective view of a vertical strip light fixture, associated elbow cover, wire raceway and stair nose tread.

FIG. 5*a* (and FIG. 7) is a more detailed front view of a strip light fixture 58 and its extrusions 60 and 65 on the riser 59, along with a top cover or cover piece 70 which provides a wire way connection to a wire way 71 on step 57, and shows a stair nose tread 72 (which can be a conventional simple plastic or metal carpet edge protector).

Figure 5B:
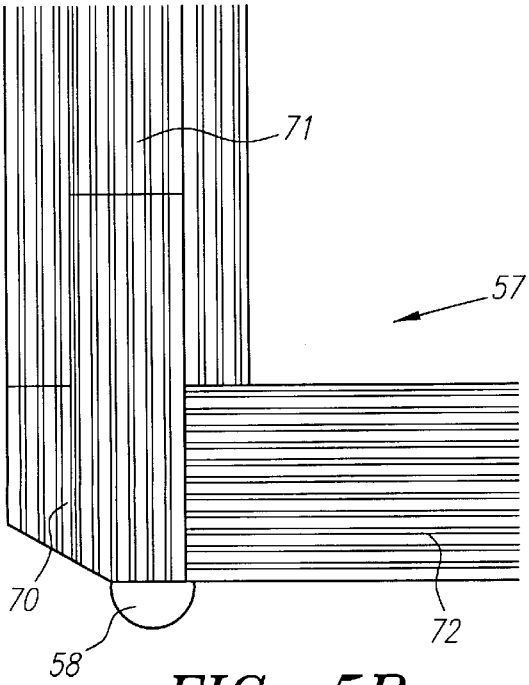
Figure 5C:
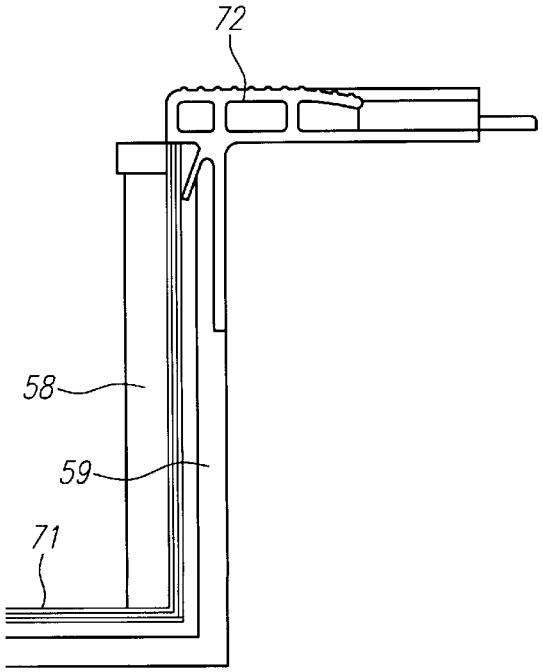
Figure 6A:
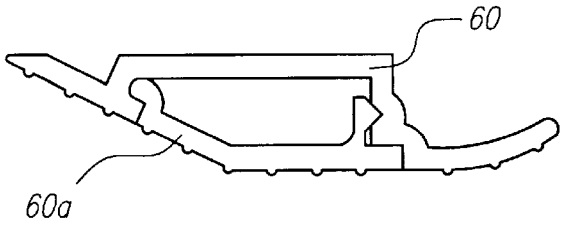
FIGS. 6*a* through 6*e* illustrate extrusions, and associated lighting fixtures (FIGS. 6*b*–6*e*), with FIGS. 6*b* through 6*e* showing alternative lighting fixtures used with a conventional extrusion of FIG. 6*a;*
Figure 6D:
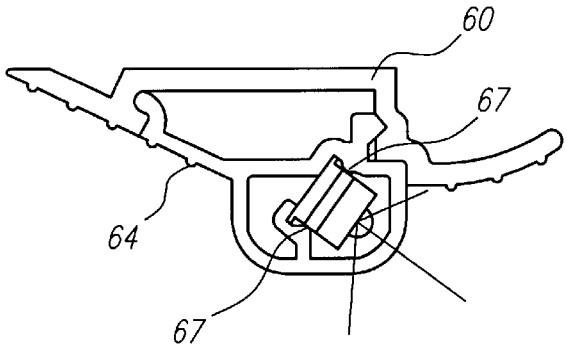

Turning now to FIG. 6, FIG. 6*a* shows a conventional extrusion 60 typically used as the base of a wire way or base of a light fixture. When used as a wire way, it has an extruded cover 60*a*. This assembly can comprise the wire way assembly 71 shown in FIG. 5.

Figure 6B:
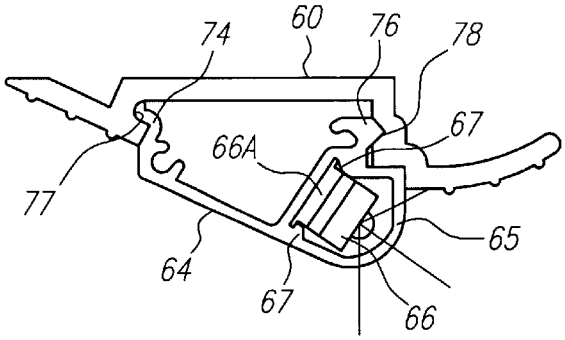
Figure 6E:
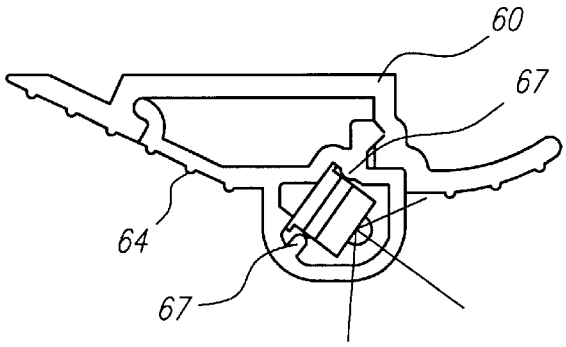
Figure 6C:
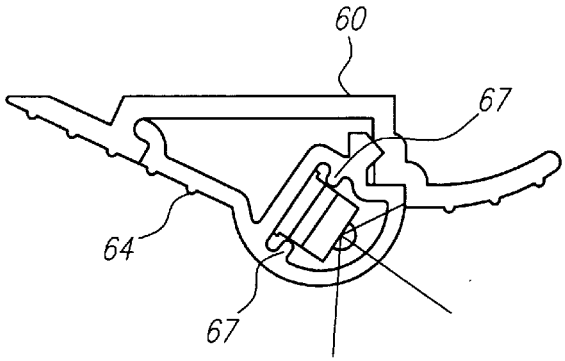

FIGS. 6*b* through 6*e* show different configurations of second extrusions 64 (the same numbers being used to illustrate like or similar components). The configuration shown in FIG. 6*b* is the preferred one because it does not have the protruding configuration of the fixture of FIGS. 6*c* through 6*e*, although all are useful and can provide slightly different lighting patterns as may be desired. The extrusion 64 in each instance has ears 74 and 76 configured to fit into suitable respective recesses 77 and 78 of the base extrusion 60. Preferably the section or area 65 is clear or translucent. The extrusion 64 can be extruded from suitable plastics such as polycarbonate, and the like, wherein the section 65 in front of the LEDs 66 is clear or translucent and the remainder can be either translucent or opaque. The LEDs 66 and their respective wire strip 66*a* can be adhered to the inside of the extrusion 64 as by an adhesive or there may be a snap or slide-in fit where in the strips 66*a* is engaged by FIGS. 67 in cavity 68 of the extension 64.

Figure 8:
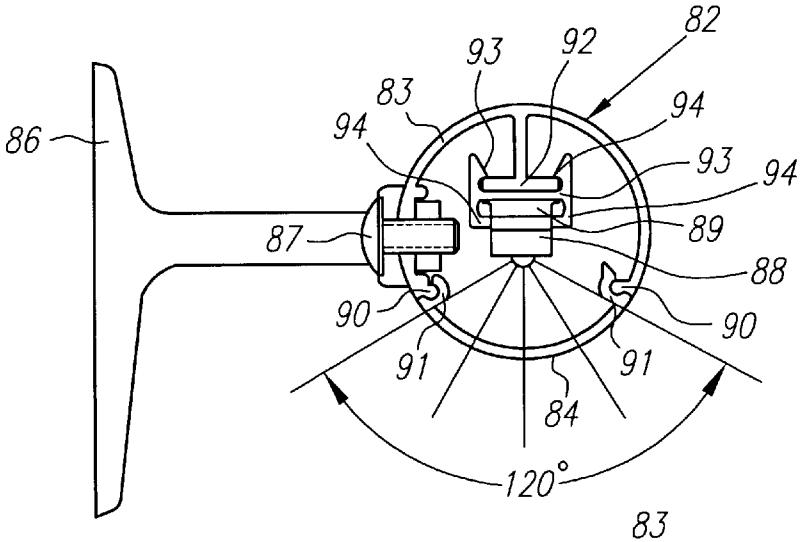
FIGS. 8 and 9 are cross-sectional views of lighted hand rails.
Figure 9:
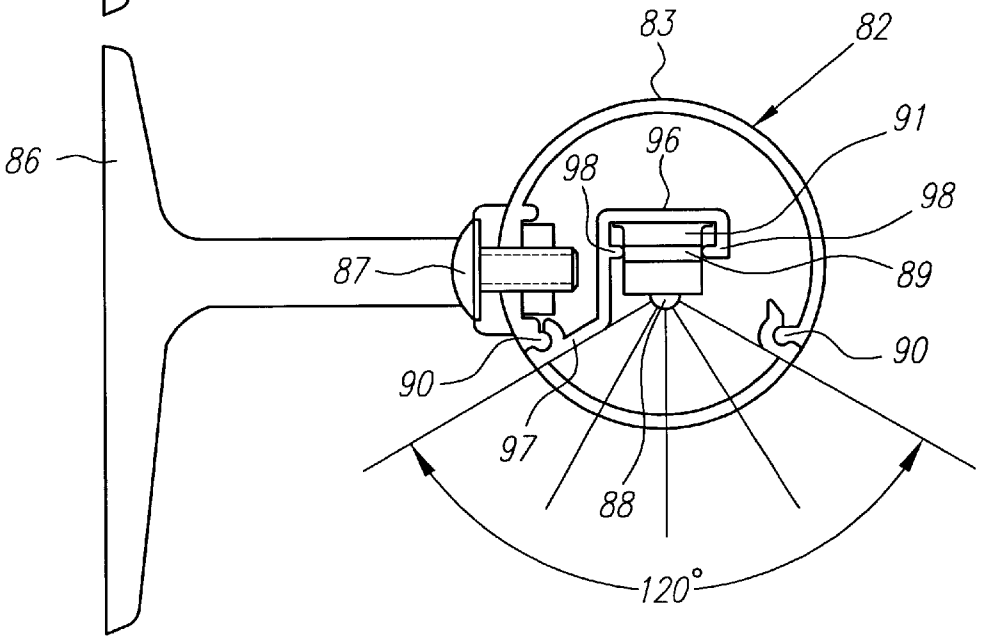

Turning now to FIGS. 8 and 9, two embodiments of lighted hand rails are shown. Like reference numerals are used for like or similar components. Each includes a hand rail generally indicated at 82, and which comprises an upper aluminum extrusion 83 and a lower clear rigid PVC or clear polycarbonate extrusion 84. A wall bracket 86 is provided for mounting the hand rail onto a wall, and the outer end thereof can be affixed to the extrusion 83 via a screw fastener 87 or the like. Both include a strip of LEDs 88 and associated wire or cable 89. The lower end of the aluminum extrusion has ears 90 on either side thereof which engage U-shaped fingers 91 of the lens 84 to allow the lens to be snapped on to and off of the aluminum extrusion 83.

The difference in the hand rails of FIGS. 8 and 9 is in the manner in which the LED 88/wire 89 assembly is mounted and supported. In the arrangement of FIG. 8, the aluminum extrusion 83 includes an inverted "T" section 92 onto which a rigid PVC "H" extrusion 93 is attached. The extrusion 93 has fingers 94 which engage the cross-member of the "T" section 92, and fingers 95 which engage and support the LED 88/wire 89 assembly.

In the arrangement of FIG. 9, the support for the LED 88/wire 89 assembly is provided by an inverted "L" portion 96 of the lens extrusion 84. The section 96 includes an arm 97 extending upwardly from the lens, and further includes inwardly directed fingers 98 which engage and hold the LED 88/wire 89 assembly in place.

It will be apparent from the foregoing and from FIGS. 8 and 9 that the hand rail designs thereof include a string of LEDs 88 for providing illumination through the clear lens 84 on to the associated stairway or aisle below.

Figure 10A:
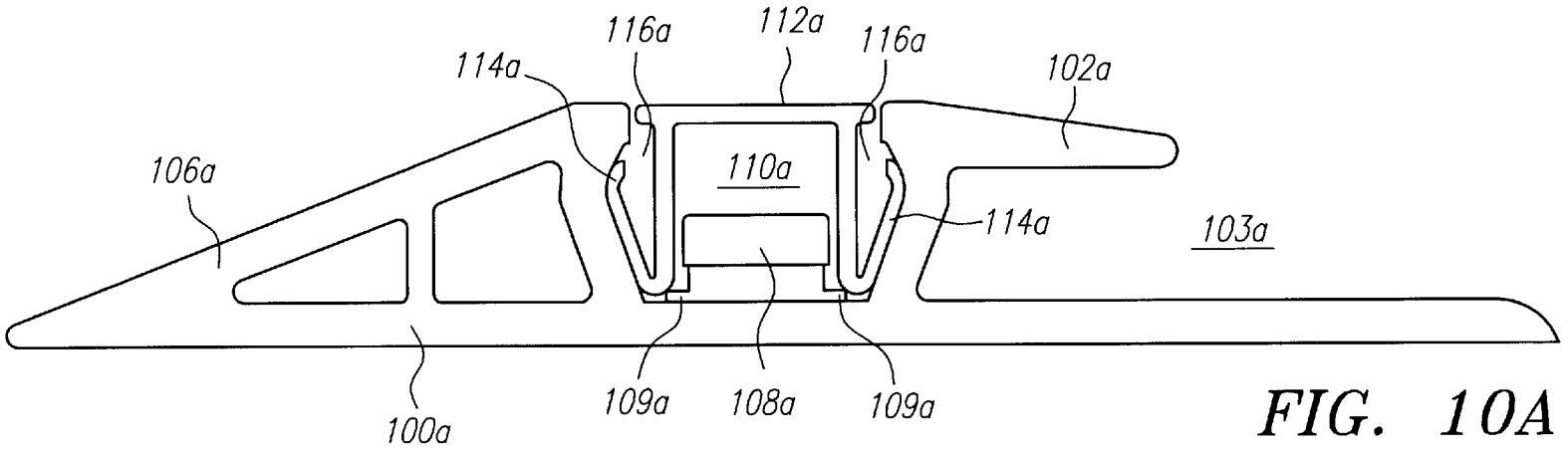
FIGS. 10*a* and 10*b* are cross-sectional views of respective carpet-to-floor and carpet-to-wall extrusions illustrating a new form of strip lighting for minimizing spilled liquid damage to the strip lights thereof, and which is designed to facilitate clean-up of liquid spills in the strip lighting system.
Figure 10B:
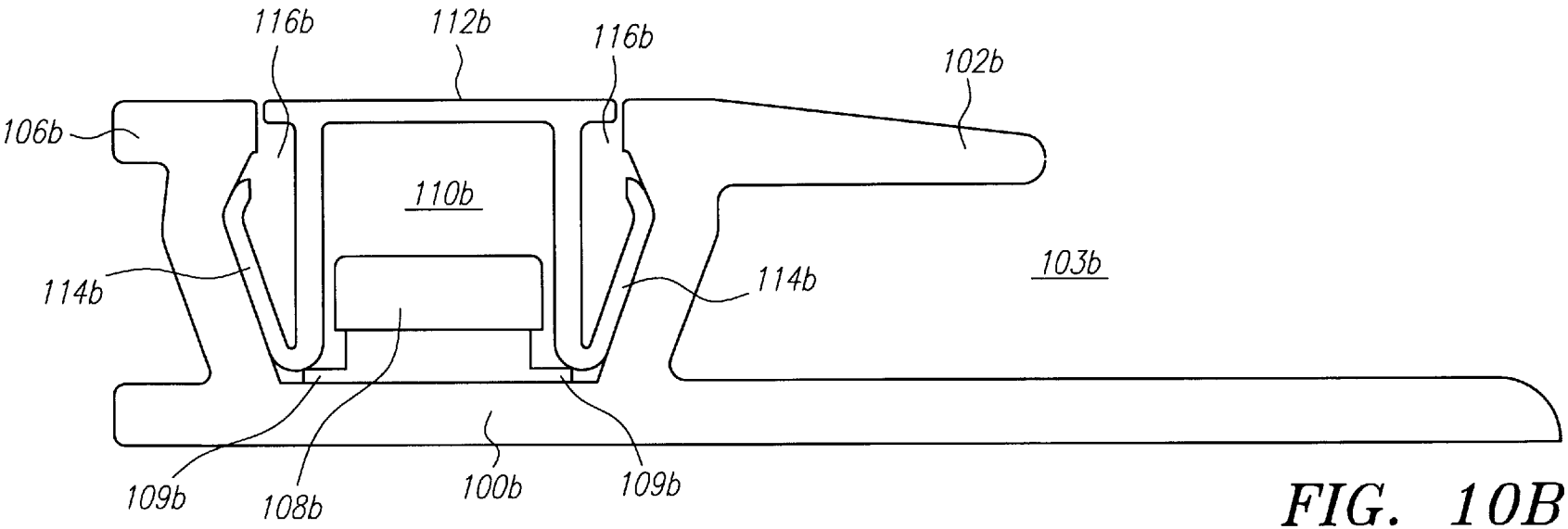

Turning now to FIGS. 10*a* and *b*, FIG. 10*a* is a cross-sectional view of a carpet-to-floor extrusion and FIG. 10*b* is a cross-sectional view of a carpet-to-wall extrusion. The design of these extrusions minimizes spilled liquid damage to the strip lights thereof and facilitate clean-up of liquid spills thereon. They include a base extrusion 100*a* and 100*b*, respectively, each of which has a lip identified as 102*a* and 102*b* forming a carpet slot 103*a* and 103*b*. The carpet-to-floor extrusion 100*a* includes a triangular edge feathered down to an adjacent floor area (not shown) 106*a;* whereas, the carpet-to-wall extrusion 100*b* includes an edge 106*b* which abuts an adjacent wall (not shown). Each fixture includes an LED strip 108*a* and 108*b* and base flanges 109*a* and 109*b* held down in the channel on the respective base section 100*a* and 100*b* by the legs 114*a* and 114*b* of the respective lens 112*a* and 112*b*.

The principal feature of the fixtures shown in 10*a* and *b* is the inclined cavities 110*a* and 110*b* along with cover extrusions 112*a* and 112*b*, wherein the extrusions 112*a*, 112*b* have upturned fingers 114*a* and 114*b* which both allow the covers 112*a*, *b* to be snapped into (and snapped out of) the cavity 110*a*, 110*b*, while providing areas 116*a* and 116*b* essentially forming reservoirs for liquid that may be spilled onto the fixture. This arrangement and configuration provides both a sealed cover over the LED strips 108*a*, 108*b*, and areas (116*a*, 116*b*) where spilled liquid can collect without impinging on or seeping into the LED strip 108*a*, 108*b*. In the event of a liquid spill, the cover 112*a*, 112*b* can be easily removed to clean up the spillage. The LEDs can be easily removed since they are not fixed to the base 100*a* and 100*b*, but held down by the cover. The lamps 108*a*, 108*b* preferably are LEDs; however, other forms of lamps can be used.

In each embodiment, the lamps preferably are low voltage (e.g., 12 or 24 volt) LEDs not requiring transformers; however, other types of lamps, such as incandescent, also the foregoing system are all replaceable lamp or LED systems.

While embodiments of the present invention have been shown and described, various modifications may be made without departing from the scope of the present invention, and all such modifications and equivalents are intended to be covered.

What is claimed is:

1. A theater lighting system for providing light on stairs and risers of stairways comprising at least one strip light fixture to be disposed vertically on a side of a stair riser and comprising a base extrusion adapted to be fixed to the stair riser and including a lip under which an edge of riser carpet can be disposed, a second extrusion of plastic having at least a clear or translucent area for allowing light to pass therethrough, the second extrusion including a cavity for receiving a string of lamps, or LEDs and a string of lamps or LED's disposed in the cavity of the second extrusion for directing light through the clear or translucent area thereof toward an adjacent riser and step.

2. A fixture as in claim 1 wherein the first and second extrusions have cooperatively mating sections for enabling the second extrusion to be snapped into and held in the first extrusion.

3. A fixture as in claim 1 wherein the second extrusion has fingers extending into the cavity thereof for holding the light string therein.

4. A fixture as in claim 1 wherein light fixtures are disposed on each side of a stair riser, and wire ways are connected to the respective ends thereof for providing wires and electrical power to the light strings.

5. A lighting system for theaters and the like for providing light on stairs and risers of stairways comprising at least one light fixture to be disposed vertically on a side of a stair riser and further comprising a first member adapted to be affixed to the side of the stair riser and to form a wireway and base for a light fixture, the first member including at least a lip under which an edge of riser carpet can be disposed, a second member including at least a clear or translucent area thereof for allowing light to pass therethrough, the second member adapted to be connected with the first member, and a plurality of lamps or LEDs disposed in the second member for directing light through the clear or translucent area thereof toward an adjacent riser and step.

6. A fixture as in claim 5 wherein a pair of light fixtures are disposed on each side of the stair riser, and further wireways are connected to the ends thereof for providing wires and electrical power to the lights of the light fixtures.

7. A lighting system for theaters and the like for providing light on stairs and risers of stairways comprising at least one light fixture to be disposed vertically on a side of a stair riser and further comprising a first member adapted to be affixed to the side of the stair riser and to form a wireway and base for a light fixture, the first member adapted to be connected to a further wireway for providing external power to the light fixture, a second member including at least a clear or translucent area thereof for allowing light to pass therethrough, the second member adapted to be connected with the first member, and a plurality of lamps or LEDs disposed in the second member for directing light toward an adjacent riser and step, at least some of the light being passed through the clear or translucent area thereof.

8. A fixture as in claim 7 wherein a pair of light fixtures are disposed on each side of the stair riser, and wireways are connected to the ends thereof for providing wires and electrical power to the lights of the light fixtures.

9. A lighting system for theaters and the like for providing light on stairs and risers of stairways comprising at least one light fixture to be disposed vertically on a side of a stair riser and further comprising a first member adapted to be affixed in a vertical orientation to the side of the stair riser and to form a wireway and base for a light fixture, the first member adapted to be connected to a further wireway for providing external power to the light fixture, a second member for receiving and supporting a plurality of lamps or LEDs, the second member adapted to be connected with the first member, and a plurality of lamps or LEDs disposed in the second member for directing light therefrom toward an adjacent riser and step.

10. A fixture as in claim 9 wherein a pair of light fixtures are disposed on each side of the stair riser, and wireways are connected to the ends thereof for providing wires and electrical power to the lights of the light fixtures.

* * * * *